US009242454B2

(12) United States Patent
Rancourt et al.

(10) Patent No.: US 9,242,454 B2
(45) Date of Patent: Jan. 26, 2016

(54) INDEPENDENT INKER CONTROL AND METHOD

(71) Applicant: GOSS INTERNATIONAL AMERICAS, INC., Durham, NH (US)

(72) Inventors: Michael Raymond Rancourt, Merrimack, NH (US); Howard W. Hoff, Lee, NH (US); Brian Robert Elkinson, Barrington, NH (US); William J. Derocher, Newmarket, NH (US)

(73) Assignee: GROSS INTERNATIONAL AMERICAS, INC., Durham, NH (US)

( * ) Notice: Subject to any disclaimer, the term of this patent is extended or adjusted under 35 U.S.C. 154(b) by 0 days.

(21) Appl. No.: 14/502,340

(22) Filed: Sep. 30, 2014

(65) Prior Publication Data

US 2015/0090137 A1 Apr. 2, 2015

Related U.S. Application Data

(60) Provisional application No. 61/904,760, filed on Nov. 15, 2013.

(51) Int. Cl.

| | |
|---|---|
| ***B41F 33/10*** | (2006.01) |
| ***B41M 1/06*** | (2006.01) |
| ***B41F 33/00*** | (2006.01) |
| ***B41F 31/02*** | (2006.01) |
| ***B41F 7/04*** | (2006.01) |
| ***B41F 7/00*** | (2006.01) |
| ***B41F 31/00*** | (2006.01) |
| ***B41F 31/20*** | (2006.01) |

(52) U.S. Cl.

CPC ..... *B41F 33/0063* (2013.01); *B41F 7/00* (2013.01); *B41F 7/04* (2013.01); *B41F 31/004* (2013.01); *B41F 31/02* (2013.01); *B41F 31/20* (2013.01); *B41F 33/10* (2013.01)

(58) Field of Classification Search

CPC ..... B41F 33/0009; B41F 33/10; B41F 33/12; B41F 31/02; B41F 31/004; B41F 7/00; B41F 7/04; B41P 2213/10; B41P 2213/11; B41P 2213/734; B41P 2233/11

USPC ..... 101/484, 247, 183–185, 217–219, 101/450.1, 450.4, 351.01

See application file for complete search history.

(56) References Cited

U.S. PATENT DOCUMENTS

| | | | | |
|---|---|---|---|---|
| 5,027,706 | A | 7/1991 | Niemiro et al. | |
| 5,179,978 | A | 1/1993 | Simms et al. | |
| 5,235,913 | A | 8/1993 | Richardson et al. | |
| 6,055,907 | A * | 5/2000 | Endisch et al. | 101/484 |
| 2006/0162597 | A1 | 7/2006 | Momot | |
| 2010/0326303 | A1 * | 12/2010 | Luckhardt et al. | 101/450.1 |

* cited by examiner

*Primary Examiner* — Leslie J Evanisko

(74) *Attorney, Agent, or Firm* — Davidson, Davidson & Kappel, LLC

(57) ABSTRACT

A method of inking a substrate in a printing press is provided. The printing press includes a plurality of printing units, each printing unit includes a blanket cylinder, a plate cylinder and an inker. The method includes the steps of running the plate cylinder, blanket cylinder and inker at a press speed, driving the inker independently, printing on a substrate with a desired ink film thickness at the press speed and stopping the press for a press stop event. Stopping the press further includes stopping the inker at a maximum stop rate, stopping the plate cylinder and blanket cylinder at a normal stop rate and moving the plate cylinder and blanket cylinder into an off impression position. The method further includes ramping the plate cylinder and blanket cylinder up to a desired press speed, ramping the inker up to press independently so as to match the speed of plate cylinder, returning the plate cylinder and blanket cylinder to an on impression position and printing on the substrate with the desired ink film thickness at the desired press speed.

3 Claims, 2 Drawing Sheets

INDEPENDENT INKER CONTROL AND METHOD

Priority is hereby claimed to U.S. Application 61/904,760 filed on Nov. 15, 2013, the entire disclosure of which is hereby incorporated by reference herein.

This application relates to the field of printing and in particular to the field of inkers for printing presses.

BACKGROUND INFORMATION

In the field of lithographic printing, ink is continuously conveyed from an ink source through a series of rollers to a printing plate on a plate cylinder in a printing press. Image portions of the printing plate accept ink from one or more of the last of a series of inking rollers and transfer a portion of that ink to a blanket cylinder as a reverse image from which a portion of the ink is transferred to form a correct-reading image on paper or other materials. It is also important in conventional lithographic printing processes that a dampening solution containing water and proprietary additives be conveyed continuously to the printing plate whereby transferring in part to the non-image areas of the printing plate the water functions to keep those non-image areas free of ink. Finally, in conventional printing press systems, the ink is continuously made available in varying amounts determined by cross-press column input control adjustments to a plurality of ink metering devices, such as ink injectors. Open fountain inker systems, and other systems, may also be used as ink metering devices.

Lithographic printing plate surfaces in the absence of imaging materials have minute interstices and a hydrophilic or water-loving property to enhance retention of water that is the dampening solution, rather than ink on the surface of the plate. Imaging the plate fills these interstices and creates oleophilic or ink-loving areas according to the image that is to be printed. Consequently, when both ink and dampening solution are presented to an imaged plate in appropriate amounts, only the ink tending to reside in non-image areas becomes disbonded from the plate. In general, this action accounts for the continuous ink and dampening solution differentiation on the printing plate surface, which is integral to the lithographic printing process.

During a make-ready or set up process, a printing press is prepared for a new print job. In this regard, a new print job refers to printing different images on the web as compared to an existing print job. This can be accomplished, for example, by changing the printing plate(s) on a printing unit, or by bringing a different set of printing units into contact with the web. Both require make-ready, although in the latter case, sometimes referred to as auto-transfer, the make-ready for the new print job could be performed at any time prior to the job change. In any event, during this make-ready (or set up) process, the press is adjusted and stabilized before it is ready to produce an accurate and acceptable image on the printed material. For example, adjustments are made to the press color and/or registration during start up. Thereafter, the press is run for a period of time needed for the effect of the adjustments to propagate through to the printed substrate, often referred to as the run-in time. During the run in time, the images on the printed substrate are not usable, and are often referred to as "waste." The press may need to be stopped and started a number of times as make-ready adjustments are iteratively made until acceptable print quality is achieved.

One aspect of the make-ready process is ink stabilization. In this regard, during the run-in period noted above, it is generally necessary to operate the press, applying ink and water to the printing plate and transfer the image from the plate to the blanket in order to stabilize the ink transfer process so that the desired ink thickness, typically measured by optical density, is achieved.

Conventionally, inkers and inking rollers are geared to or linked to blanket cylinder, impression cylinder or plate cylinder so the inkers or inking rollers are not controlled independently. As a result the inkers or ink rollers may not be controlled in a manner that optimizes or maintains desired ink film thickness established in the ink roller train. In order to ameliorate this, shorter ink trains and inker forcing functions have been utilized.

It is necessary to control the correct amount of ink supplied from each of the ink injectors during lithographic printing. U.S. Pat. No. 5,027,706, the entire disclosure of which is hereby incorporated by reference, describes an inking system including controls for controlling supply of ink from an ink rail to a plurality of individual ink outlet orifices corresponding to ink columns or zones.

U.S. Pat. No. 5,179,978, the entire disclosure of which is hereby incorporated by reference, describes a rotary ink valve assembly for controlling ink or printing fluid input in a printing press.

U.S. Pat. No. 5,235,913 purports to describe a device and method for stabilizing an offset lithographic printing press. A litho start-off device comprises an ink removal cylinder which can be selectively engaged and disengaged with a blanket disposed on the surface of the blanket cylinder. When engaged with the blanket cylinder, the ink removal cylinder removes ink from the blanket of the blanket cylinder. A scraper assembly is also provided to remove the ink from the ink removal cylinder as it rotates.

U.S. 2006/0162597, the entire disclosure of which is hereby incorporated by reference, describes an integrated ink rail assembly which includes a plurality of page packs, each page pack including a corresponding ink outlet orifice corresponding to an ink column or zone.

BRIEF SUMMARY OF THE INVENTION

In accordance with a first embodiment of the present invention, a method is provided of controlling the ink film thickness applied to a printed substrate in a lithographic printing press including a plurality of printing units, each printing unit including a blanket cylinder, a plate cylinder and an ink train. The method includes the steps of printing a print job on a substrate with a desired film thickness, independently driving the ink train, stopping the ink train at a quick stop rate, stopping the plate cylinder and blanket cylinder at a normal stop rate, ramping the plate cylinder and blanket cylinder up to press speed at first rate, ramping the ink train up to match a speed of the plate cylinder at a second rate so as to begin printing on the substrate with the desired film thickness.

The ink train is controlled by an independent inker axis or motor so the ink train can run irrespective of the other components of the printing press, particularly, the plate cylinder or blanket cylinder. When the printing press is stopped, the ink train may be stopped as quickly as possible, preferably instantaneously. The remaining printing press components may be stopped at another preferred rate or speed, preferably a normal stop speed. When the printing press is restarted, the press components are ramped up to press speed as desired, without running the inker. Once optimal press speed is desired, the ink train is ramped up to match the speed of the plate cylinder before the printing units are placed in an on impression position. Printing is then resumed. The resulting ink film thickness is the ink film thickness at the time the press was stopped, thus, the desired ink film thickness.

BRIEF DESCRIPTION OF THE DRAWINGS

The present invention will be further described with respect to the following Figures, in which.

DETAILED DESCRIPTION OF PREFERRED EMBODIMENTS OF THE INVENTION

Figure 1A:
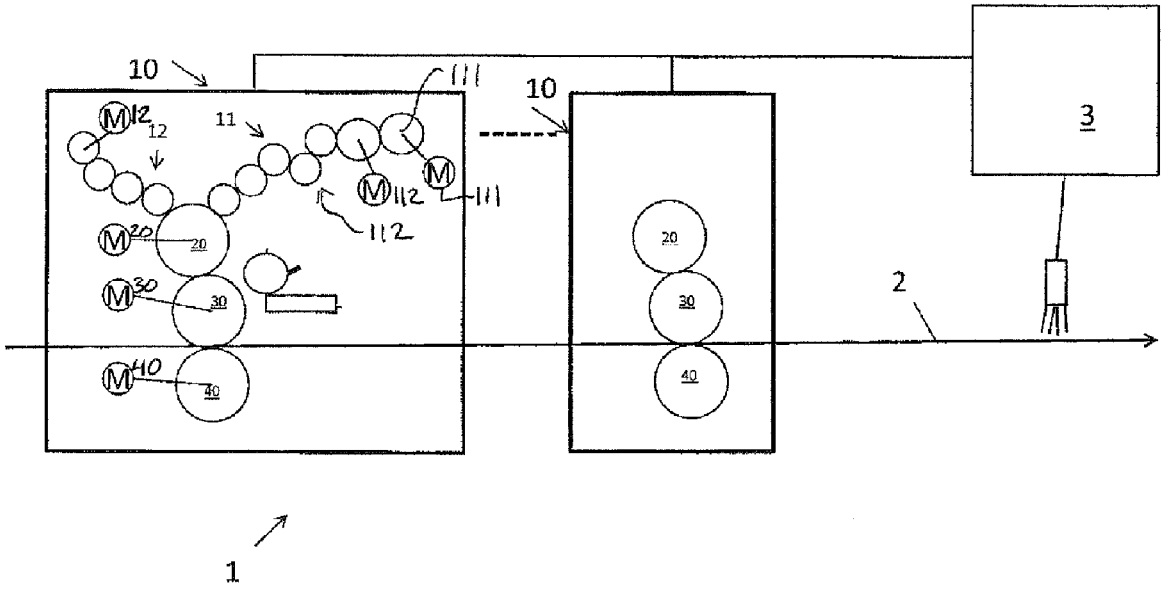
FIG. 1A shows a system in accordance with an embodiment of the present invention in an on-impression position.

As discussed above, in prior art systems, inker make-ready on offset presses was accomplished by running substrate continuously at the same surface velocity as the inker. These systems are deficient because of the amount of substrate (e.g., web) that is wasted during press start up due to improper ink film thickness on press start up.

In accordance with the embodiments of the present invention discussed below, the amount of substrate wasted during start up to achieve good optical density on the substrate is reduced.

Referring to FIGS. 1(A-B), a printing press 1 includes a plurality of printing units 10 for printing on a web 2. A controller 3 is provided for controlling the operation of the printing press 1 as is well known in the art.

Each printing unit 10 includes an ink train 11, a dampener train 12, a plate cylinder 20, and a blanket cylinder 30. Since the press shown in FIG. 1(A-B) is non-perfecting (in other words a printing unit that prints on only one side of the web), an impression cylinder 40 is shown. However, it will be appreciated that the printing units could be perfecting printing units which print on both sides of the web. In such a system, the impression cylinder would be replaced with a second blanket cylinder, and a second plate cylinder, ink train and dampener train would be located below the second blanket cylinder.

In either case, each printing unit can be placed "on impression" or "off impression" as is known in the art. FIG. 1A shows the printing units 10 "on impression." In this regard, the ink and dampener trains 11, 12 are engaged with the plate cylinder 20, the plate cylinder 20 forms a nip with the blanket cylinder 30, and the blanket cylinder 30 forms a nip with the impression cylinder 40. In this position, the printing unit can print images onto the web 2. In this regard, it should be noted that there is a removable printing plate on the plate cylinder and a removable printing blanket on the blanket cylinder. However, as used herein, the term plate cylinder should be understood to refer to the plate cylinder inclusive of the printing plate, and the term blanket cylinder should be understood to refer to the blanket cylinder inclusive of the blanket, unless the context makes clear that the plate or blanket has been removed.

Figure 1B:
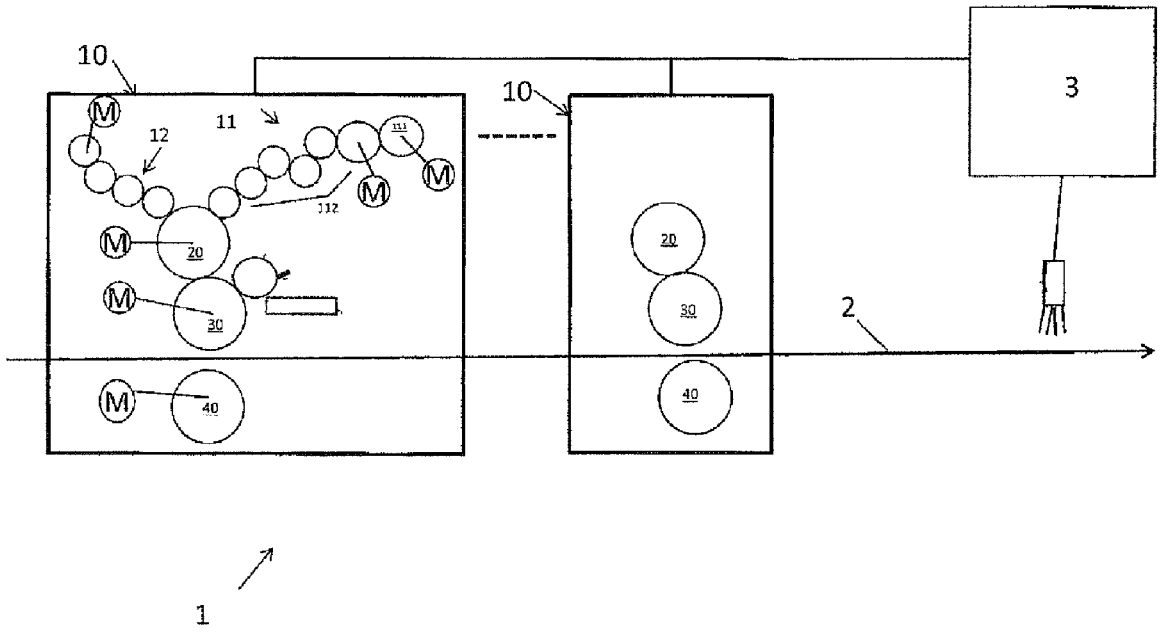
FIG. 1B shows the system of FIG. 1A in an off-impression position.

FIG. 1B shows the printing units 10 is in an off-impression position. In this position, the blanket cylinder 30 is spaced apart from the web 2. This can be accomplished in a number of ways which are known in the art.

In a non-perfecting press, moving the impression cylinder 30 out of contact with the blanket cylinder 20 will typically cause the blanket cylinder 30 to come out of contact with the web.

Alternatively, the blanket cylinder 30 could be moved upward out of contact with the impression cylinder 40 while the impression cylinder 40 either remains in a fixed position or moves downward. This may or may not require movement of the plate cylinder 20, ink train 11, and/or dampening train 12. For example, depending on the arrangement, blanket cylinder 30 could move in an arcuate upward path while the plate cylinder remains in place.

In a perfecting printing unit, the upper blanket cylinder would move upward and/or the lower blanket cylinder would move downward. Depending on the arrangement of the plate cylinder, ink train and dampener train, these components may also move when the printing unit is taken off impression. As illustrated in FIGS. 1A and 1B, in each printing unit 10, the inker 11, dampener 12, plate cylinder 20, blanket cylinder 30, and impression cylinder 40 are each driven by an independent motor (M). In addition, within the inker 11, the ink roll 111 may be driven independently of the ink train 112, with motors M111 and M112, respectively.

There are a wide variety of well-known mechanisms that can be used to move the various cylinders and components on and off impression. Non-limiting examples include mounting the cylinders 20, 30, and/or 40 in eccentric bearings, mounting the cylinders 20, 30, and/or 40 on pivotable brackets, mounting the cylinders 20, 30, and/or 40 on tracks or carriages, and combinations of the foregoing. These mechanisms can be actuated by the controller 3 with a wide variety of actuators, including motors, hydraulic cylinders, pneumatic cylinders, and the like.

As is well known in the art, in a non-perfecting press the speed of the web is controlled by the impression cylinder due to one or more factors including the wrap angle around the impression cylinder, the metal surface of the impression cylinder as compared to the more slippery surface of a blanket carrying ink, and/or the diameter of the impression cylinder.

Finally, in perfecting or non-perfecting units in which the upper and lower blanket cylinders or blanket cylinder and impression cylinder are spaced apart from the web in the off-impression position, it is also possible to drive the entire printing unit (or the entire press) with a single motor.

Substrate waste is a costly start-up component. Reducing start-up substrate waste is highly desirable. In accordance with a first aspect of the present invention, the inker 11 is run at higher surface speeds than the web during make-ready and the cycling process of inker charging and ink film thickness correction. During this time, the web can be stopped entirely, or moved slowly at less than half the surface speed of the inker, thereby reducing substrate waste on start-up.

Inker motion can be made completely independently of impression (web substrate) motion through the use of independent motors. Having independently driven axes for ink train, ink roll, impression cylinder, plate, and blanket makes it possible to stop running substrate and to run the ink train and ink roll independently at any speed desired. Running the ink train in this manner, at a higher speed, permits charging the ink train in less time. Production time, crew time, and machine time is therefore preserved. Preferably, the ink train, dampener train, plate cylinder, and blanket cylinder are driven at the same surface speed in order to maintain the desired ink split, which is typically 2 to 1, i.e. each successive roller transmits ½ its ink to the next roller.

An aspect of the present invention involves printing with the desired ink film thickness after the printing press has stopped for a stop event. The press may be stopped for any reason. In accordance with the present invention, the inker 11 is stopped as quickly as possible, preferably instantaneously. Thus motors M111 and M112 work to stop the inker roll 111 and the ink train 112 quickly. The remaining press components including cylinders 20, 30, 40 are stopped at a normal press stop speed by respective motors M20, M30, M40, thus more slowly. Cylinders 20, 30, 40 are moved to an off impression position (FIG. 1B) or blanket cylinder 30 may be thrown off plate cylinder 20 as well.

When printing is resumed, the reverse process may be applied. The press components including cylinders 20, 30 and 40 are ramped up to a desired press speed. When the desired press speed is achieved, the inker 11 may be ramped up to the desired press speed. Preferably, inker 11 is speed matched to plate cylinder 20. As a result, the ink film thickness transferred from inker 11 to the plate cylinder 20 is the same ink film thickness that was being transferred at the time the press stopped. Thus, by independently controlling inker 11, a return to the desired ink film thickness may be achieved more quickly after a press stop event.

It should be noted that the manner in which a controller, such as controller 3 can be configured to control the supply of ink to different ink zones is well known in the art. Controller 3 can, for example, be one or more programmable logic controller(s) (PLC), or any suitable hardware based or software based electronic controller or controllers including, for example, one or more microcomputers with related support circuitry, one or more finite static machine(s), one or more field programmable gate array(s), FPGA, or one or more application-specific integrated circuit(s), ASIC, among others.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of inking a substrate in a printing press including a plurality of printing units, each printing unit including a blanket cylinder, a plate cylinder, and an inker comprising:

running the plate cylinder, blanket cylinder and inker at a press speed;

driving the inker independently;

printing on the substrate with a desired ink film thickness at the press speed;

stopping the press for a press stop event which includes:

stopping the inker at a maximum stop rate;

stopping the plate cylinder and blanket cylinder at a normal stop rate; and moving the plate cylinder and blanket cylinder into an off impression position;

ramping the plate cylinder and blanket cylinder up to a desired press speed;

ramping the inker up to the desired press speed independently so as to match the speed of the plate cylinder;

returning the plate cylinder and blanket cylinder to an on impression position;

printing on the substrate with the desired ink film thickness at the desired press speed.

2. The method of inking a substrate as recited in claim 1, wherein the step of driving the inker independently includes using an independent inker motor.

3. The method of inking a substrate as recited in claim 1, wherein the step of stopping the press for a press stop event includes stopping the inker instantaneously.

* * * * *